US008695391B2

(12) United States Patent
Keintzel et al.

(10) Patent No.: US 8,695,391 B2
(45) Date of Patent: Apr. 15, 2014

(54) METHOD AND APPARATUS FOR SUPPRESSION OF OSCILLATIONS IN A ROLLING INSTALLATION

(75) Inventors: Georg Keintzel, Steyregg (AT); Gerald Hohenbichler, Kronstorf (AT)

(73) Assignee: Siemens Vai Metals Technologies GmbH (AT)

( * ) Notice: Subject to any disclaimer, the term of this patent is extended or adjusted under 35 U.S.C. 154(b) by 711 days.

(21) Appl. No.: 12/999,365

(22) PCT Filed: May 7, 2009

(86) PCT No.: PCT/EP2009/055526

§ 371 (c)(1),
(2), (4) Date: Feb. 9, 2011

(87) PCT Pub. No.: WO2009/153101

PCT Pub. Date: Dec. 23, 2009

(65) Prior Publication Data

US 2011/0120202 A1 May 26, 2011

(30) Foreign Application Priority Data

Jun. 18, 2008 (AT) ..... A 979/2008

(51) Int. Cl.
*B21B 37/00* (2006.01)
*B21B 31/32* (2006.01)

(52) U.S. Cl.
USPC ..... 72/6.2; 72/245

(58) Field of Classification Search
USPC ..... 72/6.2, 7.1, 8.1, 8.6, 11.4, 13.3, 205, 72/227, 245, 246, 710; 137/12
See application file for complete search history.

(56) References Cited

U.S. PATENT DOCUMENTS

| | | | | |
|---|---|---|---|---|
| 6,387,214 | B1 | 5/2002 | Kustermann et al. | |
| 6,763,694 | B1 | 7/2004 | Boulton et al. | |
| 7,155,951 | B2 | 1/2007 | Farley | |
| 7,255,000 | B2 * | 8/2007 | Pitkanen et al. | 73/159 |

FOREIGN PATENT DOCUMENTS

| | | | |
|---|---|---|---|
| CN | 1803326 | A | 7/2006 |
| CN | 1976767 | A | 6/2007 |
| CN | 1984729 | A | 6/2007 |
| DE | 60119372 | T2 | 4/2007 |
| EP | 0978589 | A2 | 2/2000 |
| EP | 1457274 | A2 | 9/2004 |

(Continued)

OTHER PUBLICATIONS

Office Action issued in corresponding Russian Patent Application No. 2011101570 with English translation.

(Continued)

*Primary Examiner* — Teresa M Ekiert
(74) *Attorney, Agent, or Firm* — Ostrolenk Faber LLP

(57) ABSTRACT

A method and an apparatus for suppression of oscillations in a rolling installation is described. By means of a hydraulic roller engagement third-octave oscillations are effectively suppressed, thus making it possible to improve the quality of the rolled material and/or the productivity of the rolling installation. A manipulated variable is supplied to an electro-hydraulic actuating element that acts on at least one hydraulic actuator for the roller engagement and has a rated flow rate of ≥50 l/min. At least a portion of the frequency response at frequencies f≥80 Hz has a magnitude drop of ≤3 dB, and the phase lag $\phi$ in this frequency range satisfies the conditions $f \geq 19 \cdot \sqrt[3]{\phi} + 3.1 \cdot 10^{-6} \cdot \phi^4$ and $\phi < 90°$.

35 Claims, 2 Drawing Sheets

(56) References Cited

FOREIGN PATENT DOCUMENTS

| | | | |
|---|---|---|---|
| EP | 1227899 | B1 | 3/2005 |
| JP | 60-118313 | A | 6/1985 |
| JP | 9267110 | A | 10/1997 |
| RU | 2 239 501 | C2 | 11/2004 |
| SU | 655448 | | 4/1979 |
| SU | 671891 | | 7/1979 |

OTHER PUBLICATIONS

Search Report dated Aug. 28, 2012 issued in corresponding Chinese Patent Application No. 200980122983.3 with English translation (7 pages).

International Search Report dated Oct. 22, 2009, issued in corresponding international application No. PCT/EP2009/055526.

* cited by examiner

METHOD AND APPARATUS FOR SUPPRESSION OF OSCILLATIONS IN A ROLLING INSTALLATION

CROSS-REFERENCE TO RELATED APPLICATIONS

The present application is a 35 U.S.C. §371 national phase conversion of PCT/EP2009/055526, filed May 7, 2009, which claims priority of Austrian Application No. A979/2008 filed Jun. 18, 2008, the contents of which are incorporated by reference herein. The PCT International Application was published in the German language.

FIELD OF THE INVENTION

The present invention relates to a method and an apparatus for suppression of oscillations in a rolling installation.

Specifically, the invention relates to a method for suppression of oscillations, in particular 3rd-octave oscillations, in a rolling installation having at least one rolling stand with roller engagement and having at least one roller set, wherein at least one permanently measured variable of the rolling installation is supplied to a regulator, a manipulated variable which varies over time is determined in real time with the aid of this regulator, and the controlled variables are kept substantially at defined nominal values by at least one actuator acting on the roller engagement.

BACKGROUND OF THE INVENTION

In the case of rolling installations, in particular cold rolling lines, it is known for undesirable oscillations to occur in certain operating states, for example strip tension, strip tension difference, coefficients of friction, thickness decrease, material strength and strip velocity, and these oscillations can lead to considerable damage to the installation, as well as to defects in the rolled material. 3rd-octave oscillations, also referred to as 3rd-octave chatter, are known by a person skilled in the art from the multiplicity of oscillations which occur in rolling processes. 3rd-octave oscillations typically occur in a frequency range from about 80 to 170 Hz, and are characterized by a high energy content and unstable oscillating states, as a result of which considerable mechanical damage can also occur to the rolling stand of a rolling installation. Since, however, these oscillations also lead to movements of the roller set and therefore to discrepancies from the nominal rolling gap, this leads to defects in the rolled material, which may be in the form of surface defects, geometric defects or else combinations thereof. Typically, when oscillations such as these occur, the personnel operating the rolling installation will immediately reduce the rolling speed, which involves a reduction in throughput (that is to say reduced productivity), and leads to the oscillations decaying. The stated frequency range for 3rd-octave oscillations depends substantially on the respective installation configuration and the rolling parameters, and may therefore also differ therefrom. In a method for suppression of oscillations (so-called "active oscillation compensation"), at least one permanently measured variable of the rolling installation is supplied to a regulator, which calculates a manipulated variable which varies over time. By acting on at least one actuator for roller engagement, it is possible to maintain the controlled variables substantially at defined nominal values, that is to say except, for example, for overshoot processes.

EP 1457274 A2 discloses a method and an apparatus for preventing 3rd and $5^{th}$-octave oscillations in a rolling stand.

In this case, at least one roller in a roller set is acted on by means of a controller and an actuator, by which means the controlled variables are kept at defined nominal values. Specific embodiments and selection criteria for the actuator cannot, however, be found in the disclosure.

SUMMARY OF THE INVENTION

The object of the invention is to provide a method and an apparatus having hydraulic roller engagement, for suppression of oscillations in a rolling installation, by means of which, in particular, 3rd-octave oscillations are effectively suppressed, thus making it possible to improve the quality of the rolled material and/or the productivity of the rolling installation.

This object is achieved by a method of the type mentioned initially, in which the manipulated variable is supplied to an electrohydraulic actuating element and this actuating element acts on at least one hydraulic actuator for the roller engagement, wherein the electrohydraulic actuating element has a rated flow rate of ≥50 l/min, and at least a portion of the frequency response at frequencies f≥80 Hz is characterized by a magnitude drop of ≤3 dB, and the phase lag $\phi$ in this frequency range satisfies the conditions $f \geq 19 \cdot \sqrt[3]{\sqrt{\phi}} + 3.1 \cdot 10^{-6} \cdot \phi^4$ and $\phi \leq 90°$.

In this case, an electrohydraulic actuating element means a hydraulic valve which can be operated electrically, for example by means of a 4 to 20 mA current signal, for example a continuous, single-stage or multiple-stage control valve, proportional valve or servovalve. Although hydraulic valves have a nonlinear response, for example in the flow characteristic, the dynamic response of valves can be characterized well by means of the frequency response. The frequency response is therefore suitable for specifying the suitability of a valve for specific purposes, in the sense of the dynamic response. The determination of the frequency response, that is to say the phase response and the magnitude response, of continuous valves is known to a person skilled in the art from, for example:

Chapter 3.7.2 Verhalten im Frequenzbereich [Response in the frequency domain] by W. Backé: reprint of a lecture on servohydraulics, $6^{th}$ edition, Institute for Hydraulic and Pneumatic Drives and Control at RWTH Aachen, 1992.

For the purposes of the disclosure, a decrease in magnitude of ≤3 dB means that the magnitude response has a value ≥−3 dB; a positive value of the magnitude drop therefore leads to a reduction in the amplitude of the output signal. Analogously, a phase lag of, for example, ≤45° can be understood to mean that the phase response has a value ≥−45°, that is to say that the output signal lags the input signal by ≤45° (LAG response). Since the frequency response depends on various operating parameters, the stated values for the phase lag and the magnitude drop can be determined at a drive level of ±50%, preferably 85% (0% corresponds to a valve which has not been operated, that is to say on that is closed; 100% corresponds to a completely operated valve, that is to say a completely open valve) and a system pressure of 70% of the rated pressure of the valve. In many cases, the frequency response can but need not necessarily be determined experimentally, since the frequency response for many valves is already stated in the data sheets. The data sheets state the magnitude response, that is to say the amplification factor between the input signal and output signal, typically using the logarithmic scale of decibels (dB for short), and the phase response, that is to say the phase difference between the input signal and the output signal, in degrees°. This notation is likewise known, for example from Backé, although statements using other units are, of course, also possible. The definition of the rated flow rate, or the rated volume flow, is known from Chapter 3.6.3, 'Rated volume flow' from Backé. The rated flow rate is determined with a pressure difference of 70 bar, with the valve slide completely operated. The values for the phase lag $\phi$ in ° can be determined from a numerical-value inequality, in which the frequency f can be inserted using Hz.

The method according to the invention can be carried out in a particularly advantageous manner if at least one portion of the frequency response of the electrohydraulic actuating element is characterized at frequencies $200 \geq f \geq 80$ Hz by a magnitude drop of ≤3 dB and, in this frequency range, the phase lag $\phi$ satisfies the conditions $f \geq 19 \cdot \sqrt[3]{\sqrt{\phi}} + 3.1 \cdot 10^{-6} \cdot \phi^4$, preferably $f \geq 23 \cdot \sqrt[3]{\sqrt{\phi}} + 3.1 \cdot 10^{-6} \cdot \phi^4$, particularly preferably $f \geq 27 \cdot \sqrt[3]{\sqrt{\phi}} + 3.1 \cdot 10^{-6} \cdot \phi^4$, and $\phi < 90°$. These advantageous embodiments make it possible to achieve further improvements in the results for the suppression of oscillations, since the phase lag of the electrohydraulic actuating element was reduced further, and/or the frequency response, that is to say the phase lag and magnitude drop, are in a frequency band which is particularly advantageous for solving the problem according to the invention.

The method according to the invention can be carried out advantageously if the acceleration in the engagement direction, a hydraulic pressure or the engagement force of a hydraulic actuator for the roller engagement is used as a permanently measured variable. This fact is immediately evident because the acceleration is linked to the hydraulic pressure and piston area of the actuator via Newton's fundamental law $F = m \cdot \ddot{x}$ where m is the mass and F is the force acting, to be precise the force F where $F = p \cdot A$, thus allowing a very sensitive and accurate measurement.

Oscillations which occur are advantageously identified particularly quickly and, as a consequence of this, are suppressed particularly rapidly, if a permanently measured variable is supplied to a regulator with a sampling time of <1 ms, preferably <0.2 ms.

A further advantageous embodiment of the method consists in that the difference in the accelerations between the value at the piston rod and the value at the cylinder housing of a hydraulic actuator for the roller engagement is used as a permanently measured variable. This embodiment makes it possible to detect particularly accurately the forces and/or accelerations which effectively occur.

In two further advantageous embodiments of the method, a permanently measured variable is filtered by means of one or more bandpass filters, preferably by more than second-order bandpass filters. These embodiments make it possible to filter frequency components which are relevant for chatter oscillations out of a measured variable, and to supply them to a regulator.

It is also advantageous that the regulator determines the manipulated variable taking account of a mathematical control rule and a model element, which characterizes the installation state and/or the installation response, and preferably contains a hydraulic and/or mechanical and/or rolling force model. This regulator according to the invention ensures that the rolling installation exhibits the desired response, which is predetermined by the manipulated variable, largely independently of the respective operating point. Since the frequency response of any actual actuating element is subject to a phase lag—particularly strongly, of course, at higher frequencies—it is advantageous for the manipulated variable to be supplied to a lead/lag element, and for the phase angle of the manipulated variable to be changed in this case. A lead/lag element makes it possible to change the phase angle of a signal, in this specific case the manipulated variable signal, and therefore to at least partially, or even completely, compensate for the phase shift caused by the actuating element.

It is also advantageous to supply the manipulated variable to a non-linear compensation element, and in this case to reduce or to compensate for non-linearities in the hydraulic roller engagement. A person skilled in the art knows, for example, that the flow characteristic of a hydraulic valve and the dynamic response of a hydraulic cylinder have significant non-linearities. Once these non-linearities are known, it is possible to overcome them completely or at least partially by means of non-linear compensation.

In a further advantageous version of the method according to the invention, the manipulated variable of the regulator is superimposed additively on a further manipulated variable, for example rolling gap regulation, in order to suppress oscillations and is supplied to an electrohydraulic actuating element, if necessary after a phase change and/or non-linear compensation. It is therefore possible to optimize the two control loops i) for suppression of oscillations and ii) for rolling gap regulation largely independently of one another, thus making it possible to improve the performance of the overall system.

The efficiency of the method according to the invention can be further improved if the supply pressure and/or the control pressure and/or the tank pressure at the electrohydraulic actuating element are/is stabilized by means of hydraulic accumulators. This measure shortens the response time of the actuating element and results in the actuating element responding uniformly, largely independently of transient pressure fluctuations.

In the case of rolling stands with high rolling forces, it is advantageous for the electrohydraulic actuating element to have a rated flow rate of ≥100 l/min, preferably ≥200 l/min. This makes it possible to use one actuating element to also produce high volume flows for operating one or more actuators for roller engagement. As noted above, the rated flow rate is determined for a pressure drop of 70 bar.

Advantageously, the size of the electrohydraulic actuating element is selected using the inequality $Q_{rated} \geq 1592 \cdot V_{cyl}$ while the cylinder volume can be entered in this numerical inequality in $m^3$, resulting in the rated volume flow $Q_{rated}$ in l/min. The cylinder volume is obtained from the formula $V_{cyl} = A_{cyl} \cdot \text{stroke}$, in which the piston area is $A_{cyl}$ and the maximum stroke of the hydraulic cylinder is "stroke". In order to achieve a particularly large dynamic range for oscillation suppression, it is advantageous to associate one and only one hydraulic actuator for roller engagement with each actuating element.

In order to allow the method according to the invention, which solves the problem on which the invention is based, to be implemented as directly as possible, it is advantageous that an electrically operated hydraulic valve, to which the manipulated variable can be supplied, and at least one hydraulic cylinder for the roller engagement, via which at least one roller in the roller set can be acted on, are provided, wherein the hydraulic valve has a rated flow rate of ≥50 l/min, at least a portion of the frequency response has a magnitude drop of ≤3 dB at frequencies f≥80 Hz and, in this frequency range, the phase lag $\phi$ satisfies the conditions $f \geq 19 \cdot \sqrt[3]{\sqrt{\phi}} + 3.1 \cdot 10^{-6} \cdot \phi^4$ and $\phi < 90°$.

In a particularly advantageous manner, the apparatus for suppression of oscillations is designed such that at least a portion of the frequency response of the hydraulic valve at frequencies ≥80 Hz, preferably $200 \geq f \geq 80$ Hz has a magnitude drop of ≤3 dB, and in this frequency range the phase lag $\phi$ satisfies the conditions $f \geq 19 \cdot \sqrt[3]{\phi} + 3.1 \cdot 10^{-6} \cdot \phi^4$, preferably $f \geq 23 \cdot \sqrt[3]{\phi} + 3.1 \cdot 10^{-6} \cdot \phi^4$, particularly preferably $f \geq 27 \cdot \sqrt[3]{\phi} + 3.1 \cdot 10^{-6} \cdot \phi^4$, and $\phi < 90°$.

In a further advantageous embodiment of the apparatus according to the invention, a measurement device is in the form of an acceleration, pressure or force sensor. The measurement devices are connected to the digital regulator for example via cable or fieldbus.

An advantageous measurement device can be achieved if a measurement device has two acceleration sensors, wherein one sensor is connected to the piston rod and one sensor is connected to the cylinder housing of a hydraulic cylinder for roller engagement. In this case, it is advantageous for the measurement axis of an acceleration sensor to be arranged parallel to the engagement direction of a hydraulic cylinder for roller engagement.

A further improvement in the dynamic characteristics of the apparatus according to the invention can be achieved if a supply line and/or a control line and/or a tank line to the hydraulic valve has a hydraulic accumulator for pressure stabilization.

When the rolling forces are high, it is advantageous to design the apparatus such that the hydraulic valve has a rated flow rate of ≥100 l/min, preferably ≥200 l/min.

Advantageously, the electrohydraulic actuating element has a rated flow rate of $Q_{rated} \geq 1592 \cdot V_{cyl}$, in which case, once again, the cylinder volume $V_{cyl}$ can be inserted in $m^3$, resulting in the rated flow rate $Q_{rated}$ in l/min.

One advantageous form of the apparatus, because it is particularly compact, can be achieved if the regulator together with the hydraulic valve forms an assembly, or the regulator is located in the immediate physical vicinity of the hydraulic valve. By way of example, the hydraulic valve is connected to the digital regulator by cable or fieldbus.

Particularly advantageous dynamic characteristics of the apparatus can be achieved if a hydraulic valve together with a hydraulic cylinder for roller engagement forms an assembly, or the hydraulic valve is located in the immediate physical vicinity of the hydraulic cylinder.

BRIEF DESCRIPTION OF THE DRAWINGS

Further advantages and features of the present invention will become evident from the following description of exemplary embodiments, which are not restrictive, with reference being made to the following figures, in which.

DETAILED DESCRIPTION OF PREFERRED EMBODIMENTS

Figure 1:
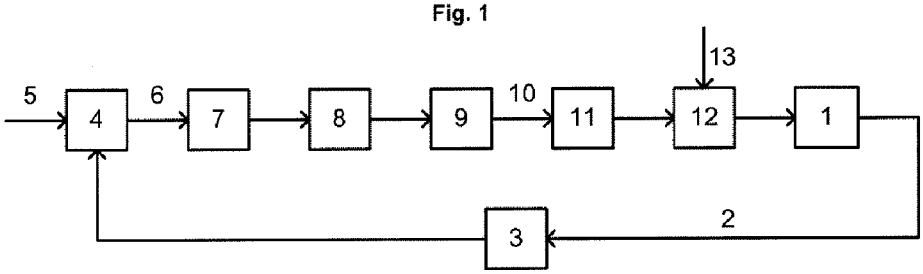
FIG. 1 shows a schematic diagram of a controlled system for suppression of oscillations.

FIG. 1 shows the basic configuration of a controlled system for suppression of oscillations. A measurement variable 2 is supplied via an acceleration sensor 1, which is connected to a roller in a rolling stand 12, to a bandpass filter 3, which is in the form of a fourth-order bandpass filter and supplies that frequency component of the measurement variable, that is to say of the acceleration signal, which is relevant for chatter oscillations to a regulator 4. This regulator 4 contains a control algorithm and model elements which characterize the installation state and calculates at least one manipulated variable 6 in real time, taking account of the filter measurement variable 2 and a nominal variable 5, which manipulated variable 6 varies over time and is supplied to a lead/lag element 7, and then to a non-linear compensation element 8. A lead/lag element 7 makes it possible to vary the phase angle of a signal, in this specific case the manipulated variable 6. Such variation of the phase angle is particularly advantageous because it can be assumed that the chatter frequency of one specific rolling installation will be substantially constant, and this knowledge can be used specifically to improve the performance of the oscillation suppression. If, for example, it is assumed that the rolling installation has a chatter frequency of 150 Hz, and, at this frequency, it is known either from a data sheet or from experimental investigations on the hydraulic valve 9, that the valve has a certain phase lag at this frequency, then this phase lag can be compensated for completely or at least partially by means of the lead/lag element 7. Following the lead/lag element 7, significant non-linearities, for example in the flow characteristic of a hydraulic servovalve 9 and/or the dynamic response of a hydraulic cylinder 11, are compensated for by means of a compensator 8. The manipulated variable signal, which has been compensated and phase-shifted, is then supplied to the hydraulic valve 9, which is in the form of a continuous, single-stage or multi-stage servovalve, proportional valve or control valve. The resultant volume flow 10 is then supplied to at least one actuator, which is in the form of a hydraulic cylinder 11 and in turn exerts forces on a roller in the roller set. This makes it possible to firstly extract energy deliberately from a disturbance variable 13, and secondly to deliberately influence the damping of the overall system. Both measures have an advantageous effect on the suppression of 3rd-octave oscillations, and thus make it possible to improve the quality of the rolled material and/or the production performance of the rolling installation.

Figure 2:
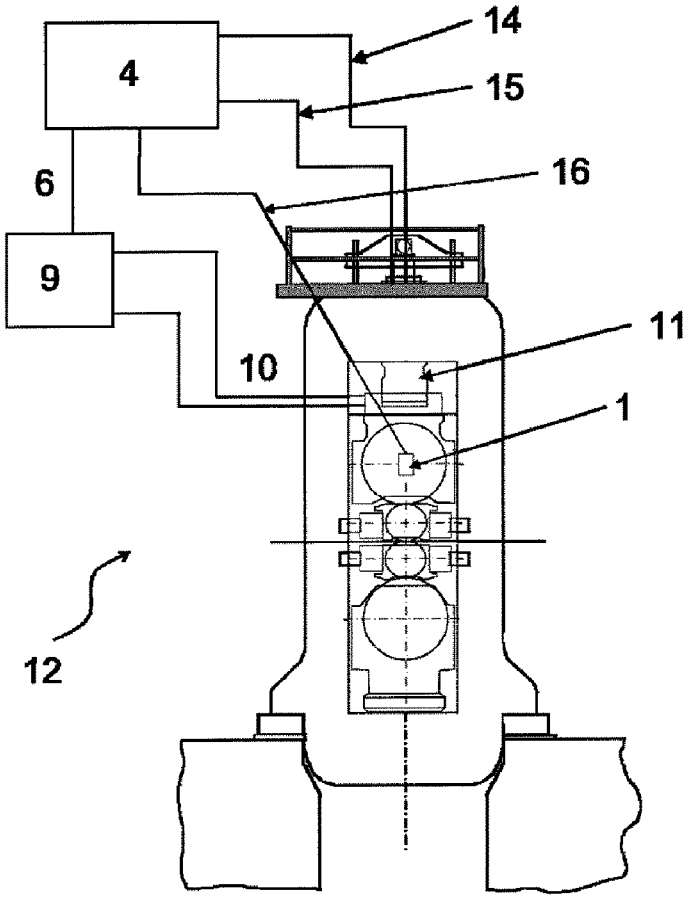
FIG. 2 shows a schematic diagram of a rolling stand having the apparatus according to the invention for suppression of oscillations.
Figure 3:
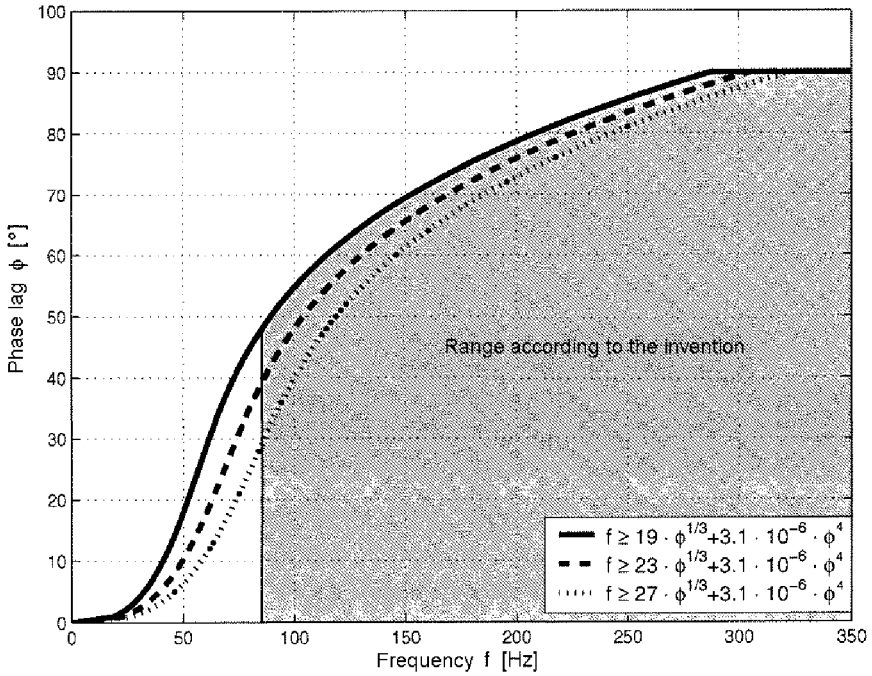
FIG. 3 shows the range according to the invention of the phase lag of an electrohydraulic actuating element.

FIG. 2 shows a rolling stand 12 of a rolling installation. In this case, a regulator 4 is connected to a hydraulic valve 9 in the form of a servovalve. A hydraulic cylinder 11, which is connected to the hydraulic valve 9, is used to act on a roller for roller engagement, in which case it is not only acted on for the engagement movement of the roller, but also to prevent oscillations. Position signals 14, pressure signals 15 and acceleration signals 16 from an acceleration sensor 1 are indicated as input variables for the regulator 4. FIG. 3 shows the phase lag according to the invention of an electrohydraulic hydraulic valve. The frequency f is plotted in Hz on the ordinate, and the phase lag $\phi$ in ° on the abscissa. For clarity reasons, the frequency range has been cut off at 350 Hz. The phase lag is calculated as follows: if, for example, there is interest in a frequency f for a phase lag of 60°, that is to say the frequency at which the phase response $\phi = -60°$, then the value $\phi = 60°$ is inserted in the equation $f \geq 19 \cdot \sqrt[3]{\phi} + 3.1 \cdot 10^{-6} \cdot \phi^4$. This results in a value of f=114.6 Hz, that is to say the phase response of the valve according to the invention may have a phase lag of $\phi = 60°$ only at frequencies f≥114.6 Hz, that is to say the phase response will be less than the value $\phi = -60°$ only at frequencies f≥114.6 Hz.

LIST OF REFERENCE SYMBOLS

1 Acceleration sensor
2 Measurement variable
3 Bandpass filter
4 Regulator
5 Nominal variable
6 Manipulated variable
7 Lead/lag element
8 Compensator

9 Hydraulic valve
10 Volume flow
11 Hydraulic cylinder
12 Rolling stand
13 Disturbance variable
14 Position signal
15 Pressure signal
16 Acceleration signal

What is claimed is:

1. A method for suppression of third-octave oscillations in a rolling installation having at least one rolling stand with roller engagement and having at least one roller set, the method comprising:

supplying at least one measured variable of the rolling installation to a regulator;

determining in real time with the aid of the regulator a manipulated variable which varies over time;

keeping at defined nominal values controlled variables by at least one actuator acting on the roller engagement;

supplying the manipulated variable to an electrohydraulic actuating element;

the actuating element acting on at least one hydraulic actuator for the roller engagement, wherein the electrohydraulic actuating element has a rated flow rate of ≥50 l/min, and at least a portion of the frequency response at frequencies f≥80 Hz has a magnitude drop of ≤3 dB, and the phase lag $\phi$ in this frequency range satisfies the conditions $f \geq 19 \cdot \sqrt[3]{\phi} + 3.1 \cdot 10^{-6} \cdot \phi^4$ and $\phi < 90°$.

2. The method as claimed in claim 1, wherein at least one portion of the frequency response of the electrohydraulic actuating element at frequencies f≥80 Hz has a magnitude drop of ≤3 dB and, in this frequency range, the phase lag $\phi$ satisfies the conditions $f \geq 23 \cdot \sqrt[3]{\phi} + 3.1 \cdot 10^{-6} \cdot \phi^4$ and $\phi < 90°$.

3. The method as claimed in claim 2, wherein the phase lag $\phi$ satisfies the condition $f \geq 27 \cdot \sqrt[3]{\phi} + 3.1 \cdot 10^{-6} \cdot \phi^4$.

4. The method as claimed in claim 1, wherein at least one portion of the frequency response of the electrohydraulic actuating element at frequencies 200≥f≥80 Hz has a magnitude drop of ≤3 dB and, in this frequency range, the phase lag $\phi$ satisfies the conditions $f \geq 19 \cdot \sqrt[3]{\phi} + 3.1 \cdot 10^{-6} \cdot \phi^4$ and $\phi < 90°$.

5. The method as claimed in claim 4, wherein the phase lag $\phi$ satisfies the condition $f \geq 23 \cdot \sqrt[3]{\phi} + 3.1 \cdot 10^{-6} \cdot \phi^4$.

6. The method as claimed in claim 4, wherein the phase lag $\phi$ satisfies the condition $f \geq 27 \cdot \sqrt[3]{\phi} + 3.1 \cdot 10^{-6} \cdot \phi^4$.

7. The method as claimed in claim 1, wherein the measured variable comprises one of the acceleration in the engagement direction, a hydraulic pressure or the engagement force of a hydraulic actuator for the roller engagement.

8. The method as claimed in claim 7, wherein the measured variable is supplied to the regulator with a sampling time of <1 ms.

9. The method as claimed in claim 8, wherein the sampling time is <0.2 ms.

10. The method as claimed in claim 7, wherein the measured variable is set based on a difference in accelerations between a value at the piston rod and a value at the cylinder housing of a hydraulic actuator for the roller engagement.

11. The method as claimed in claim 7, wherein the measured variable is filtered by means of one or more bandpass filters.

12. The method as claimed in claim 7, wherein the measured variable is filtered by means of one or more bandpass filters, which is or are higher than second order.

13. The method as claimed in claim 7, wherein the regulator determines the manipulated variable taking account of a mathematical control rule and a model element, which corresponds to the installation state and/or the installation response.

14. The method as claimed in claim 13, wherein the regulator determines the manipulated variable based on a hydraulic and/or mechanical and/or rolling force model.

15. The method as claimed in claim 1, comprising supplying the manipulated variable to a lead/lag element, and the phase angle of the manipulated variable is varied.

16. The method as claimed in claim 1, comprising supplying the manipulated variable to a non-linear compensation element, and non-linearities in the hydraulic roller engagement are reduced or compensated for.

17. The method as claimed in claim 1, comprising:

superimposing the manipulated variable of the regulator additively on a further manipulated variable for rolling gap regulation, in order to suppress oscillations; and supplying the result to an electrohydraulic actuating element after a phase change and/or non-\linear compensation.

18. The method as claimed in claim 1, comprising stabilizing the supply pressure and/or the control pressure and/or the tank pressure at the electrohydraulic actuating element by means of hydraulic accumulators.

19. The method as claimed in claim 1, wherein the electrohydraulic actuating element has a rated flow rate of ≥100 l/min.

20. The method as claimed in claim 19, wherein the electrohydraulic actuating element has a rated flow rate of ≥200 l/min.

21. The method as claimed in claim 1, wherein the electrohydraulic actuating element has a rated flow rate of $Q_{rated} \geq 1592 \cdot V_{cyl}$, and an actuating element acts on one and only one hydraulic actuator for the roller engagement.

22. An apparatus for suppression of third-octave oscillations in a rolling installation comprising a rolling stand, a roller engagement, at least one roller set, at least one measurement device configured to measure a variable of the rolling installation, and a regulator configured to receive the measured variable, to determine in real time at least one manipulated variable which varies over time, the apparatus comprising:

an electrically operated hydraulic valve configured to receive the manipulated variable; and at least one hydraulic cylinder for the roller engagement, the at least one hydraulic cylinder configured to act on at least one roller in the roller set, wherein the hydraulic valve has a rated flow rate of ≥50 l/min, at least a portion of the frequency response at frequencies f≥80 Hz has a magnitude drop of ≤3 dB, and the phase lag $\phi$ in this frequency range satisfies the conditions $f \geq 19 \cdot \sqrt[3]{\phi} + 3.1 \cdot 10^{-6} \cdot \phi^4$ and $\phi < 90°$.

23. The apparatus as claimed in claim 22, wherein at least a portion of the frequency response of the hydraulic valve has a magnitude drop of ≤3 dB at frequencies ≥80 Hz, and, in this frequency range, the phase lag $\phi$ satisfies the conditions $f \geq 23 \cdot \sqrt[3]{\phi} + 3.1 \cdot 10^{-6} \cdot \phi^4$ and $\phi < 90°$.

24. The apparatus as claimed in claim 23, wherein the phase lag $\phi$ satisfies the condition $f \geq 27 \cdot \sqrt[3]{\phi} + 3.1 \cdot 10^{-6} \cdot \phi^4$.

25. The apparatus as claimed in claim 22, wherein at least a portion of the frequency response of the hydraulic valve has a magnitude drop of ≤3 dB at frequencies 200≥f≥80 Hz and, in this frequency range, the phase lag $\phi$ satisfies the conditions $f \geq 19 \cdot \sqrt[3]{\phi} + 3.1 \cdot 10^{-6} \cdot \phi^4$, preferably $f \geq 23 \cdot \sqrt[3]{\phi} + 3.1 \cdot 10^{-6} \cdot \phi^4$ and $\phi < 90°$.

26. The apparatus as claimed in claim 25, wherein the phase lag $\phi$ satisfies the condition $f \geq 27 \cdot \sqrt[3]{\phi} + 3.1 \cdot 10^{-6} \cdot \phi^4$.

27. The apparatus as claimed in claim 22, wherein the measurement device is an acceleration sensor, a pressure sensor or a force sensor.

28. The apparatus as claimed in claim 22, wherein the measurement device comprises two acceleration sensors, wherein a first sensor of the two acceleration sensors is connected to the piston rod and a second sensor of the two acceleration sensors is connected to the cylinder housing of a hydraulic cylinder for roller engagement.

29. The apparatus as claimed in one of claim 22, wherein a measurement axis of an acceleration sensor is arranged parallel to the engagement direction of a hydraulic cylinder for roller engagement.

30. The apparatus as claimed in claim 22, and further comprising a hydraulic accumulator for pressure stabilization and a supply line and/or a control line and/or a tank line to the hydraulic valve.

31. The apparatus as claimed in claim 22, wherein the hydraulic valve has a rated flow rate of ≥100 l/min.

32. The apparatus as claimed in claim 31, wherein the hydraulic valve has a rated flow rate of ≥200 l/min.

33. The apparatus as claimed in claim 22, wherein the hydraulic valve has a rated flow rate of $Q_{rated} \geq 1592 \cdot V_{cyl}$.

34. The apparatus as claimed in claim 22, wherein the regulator together with the hydraulic valve forms an assembly, or the regulator is located in the immediate physical vicinity of the hydraulic valve.

35. The apparatus as claimed in claim 22, wherein a hydraulic valve together with a hydraulic cylinder for roller engagement forms an assembly, or the hydraulic valve is located in the immediate physical vicinity of the hydraulic cylinder.

* * * * *

UNITED STATES PATENT AND TRADEMARK OFFICE

CERTIFICATE OF CORRECTION

PATENT NO. : 8,695,391 B2
APPLICATION NO. : 12/999365
DATED : April 15, 2014
INVENTOR(S) : Keintzel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 760 days.

Signed and Sealed this
Twenty-ninth Day of September, 2015

Michelle K. Lee

Michelle K. Lee
*Director of the United States Patent and Trademark Office*